US006893004B2

(12) United States Patent
Ploeger

(10) Patent No.: US 6,893,004 B2
(45) Date of Patent: May 17, 2005

(54) TRIM PANEL REMOVAL TOOL

(75) Inventor: Randall J. Ploeger, Clarinda, IA (US)

(73) Assignee: Lisle Corporation, Clarinda, IA (US)

( * ) Notice: Subject to any disclaimer, the term of this patent is extended or adjusted under 35 U.S.C. 154(b) by 112 days.

(21) Appl. No.: 10/387,735

(22) Filed: Mar. 13, 2003

(65) Prior Publication Data

US 2004/0178395 A1 Sep. 16, 2004

(51) Int. Cl.[7] ..... B66F 15/00
(52) U.S. Cl. ..... 254/25
(58) Field of Search ..... 254/25, 21, 131.5, 254/18, 131; 29/267; 7/166; 81/45, 46

(56) References Cited

U.S. PATENT DOCUMENTS 870,672 A * 11/1907 Frink et al. ..... 254/25
4,670,932 A * 6/1987 Williams ..... 254/25

OTHER PUBLICATIONS

Snap–On Tools: Part#ASG 187—Soft Grip Trim Pad Tools. Published and made available, on information and belief, more than one year prior to the filing date of the U.S. application.

Disclosure of Ted K. Hunter dated Oct. 29, 1999 for Clip–Lift Tool.

* cited by examiner

*Primary Examiner*—Robert C. Watson
(74) *Attorney, Agent, or Firm*—Banner & Witcoff, Ltd.

(57) ABSTRACT

A trim panel removal tool is comprised of a thin metal blade having slots in one end and a lever arm at the opposite end. The slots of the blade may be inserted under the head of a fastener for attaching a trim panel or trim piece to a substrate panel, and the tool may then be twisted to cause disengagement of the trim panel fastener from the substrate panel.

1 Claim, 1 Drawing Sheet

TRIM PANEL REMOVAL TOOL

BACKGROUND OF THE INVENTION

In the principal aspect the present invention relates to a tool useful for the removal of trim or trim panels from a substrate pane, for removal of for example, trim panels incorporated in the interior of a vehicle.

Various apparatus have been proposed for the removal of fasteners that secure interior vehicle door panels and trim pieces without damage to the trim panel or trim and without damage to the substrate panel on which the trim panel or trim is mounted. Typically, such apparatus are in the form of a screwdriver wherein the blade end of the screwdriver is formed with a notch. The blade is then fitted under the head of the panel fastener with the notch surrounding the stem of the fastener. The tool may then be pivoted to pry the fastener as well as the trim panel from the substrate panel. While such tools are very useful, there are situations in which such tools are difficult to manipulate and in which their utility becomes questionable. Thus, there has developed a need for an improved trim panel removal tool.

SUMMARY OF THE INVENTION

Briefly, the present invention comprises a trim panel removal tool designed to engage a fastener that holds a trim panel in position on a substrate panel and, by means of a twisting action of the tool, relieve the fastener from engagement with the substrate panel. The tool comprises a generally elongate flat metal blade with notches formed in a distal end and on one side of the blade adjacent the distal end. The opposite side of the blade provides an axis of rotation or fulcrum whereby twisting of the blade, once a notch is inserted under the head of a panel or trim fastener, will drive or remove the fastener from the substrate panel. The tool is comprised of a thin metal blade so that it can be easily inserted between a trim panel or trim and the substrate panel. Rotation of the blade upon proper insertion causes the engaged fastener to be easily disengaged from the substrate panel. A handle or grip for the blade defines a lever which enables rotation of the blade about an edge or side of the blade while the notch in another edge or the end of the blade is engaged with a fastener of the trim panel or trim.

Thus, it is an object of the invention to provide an improved trim panel removal tool.

It is a further object of the invention to provide a trim panel removal tool, which is rugged, inexpensive, and easily used in a variety of circumstances.

Yet another object of the invention is to provide a trim panel removal tool comprised of a thin blade of metal which may be inserted between a trim panel and a substrate panel to engage panel fasteners and cause those fasteners to be easily disengaged from the substrate panel by a twisting action of the tool.

Yet another object of the invention is to provide an improved trim panel remover tool, which may be utilized for removal of a wide variety of trim panels and trim.

These and other objects, advantages and features of the invention will be set forth in the detailed description which follows.

BRIEF DESCRIPTION OF THE DRAWING

In the detailed description of which follows reference will be made to the drawing comprised of the following figures.

DESCRIPTION OF THE PREFERRED EMBODIMENTS

Figure 1:
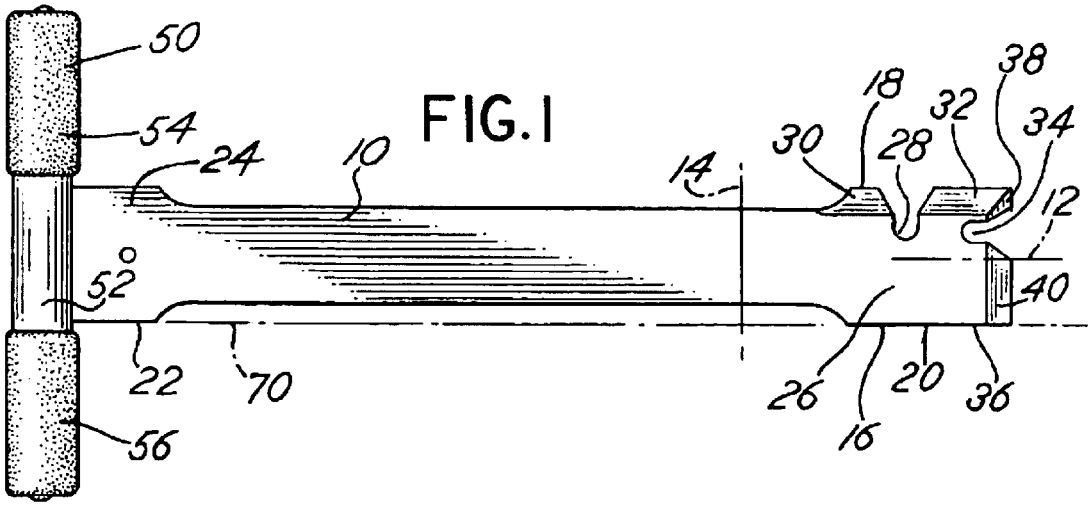
FIG. 1 is a top plan view of the tool of the invention.
Figure 2:
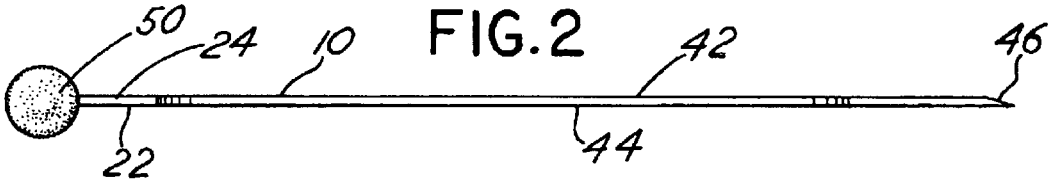
FIG. 2 is a side elevation of the tool of FIG. 1.

Referring to the figures, the tool of the invention comprises an elongate blade 10 having a longitudinal axis 12 and a transverse axis 14 generally at a right angel to the longitudinal axis 12. The blade 10 is fabricated from a sheet metal material, by way of example, a 1050 CF Steel. The blade 10 further includes an inside edge 16 and an outside edge 18. The inside edge 16 may be a continuous straight line parallel to axis 12 or may include a first or distal end section 20 and a second or grip end section 22 which are aligned to define a straight line pivot axis. The blade 10 further includes a grip end 24 and an opposite end a fastener-engaging end 26.

The fastener engaging end 26 includes a first or generally transverse slot 28, which extends partially inwardly into the blade 10 from outside edge 18 and includes sharpened edges 30 and 32 on opposite sides of the slot 28. The inner end of slot 28 is spaced transversely from the inside edge 16, and slot 28 is generally transverse to the longitudinal axis 12.

A second slot 34 is formed in the distal end 36 between the inside edge 16 and outside edge 18. The second slot 34 includes sharpened edges 38 and 40 on opposite sides of the second or distal end slot 34.

The blade 10 further includes a top side 42 and a bottom side 44. The sharpened edges 38 and 40 are comprised of the bottom side or surface 44 and an inclined edge surface 46. The sharpened edges 30 and 32 are similarly formed in the top edge 18 by a combination of the flat planar bottom face 44 and an inclined surface 47.

Affixed to the grip end 24 is a lever or handle 50. The lever or handle 50 may comprise a bar 52 welded to blade 10 with handle grips 54 and 56. The blade 10 has a transverse dimension, which is the distance between inside edge 16 and the outside edge 18. In a preferred embodiment, the longitudinal dimension is at least five times greater than the transverse dimension which is the distance between the very distal end of the blade 10 and the grip or lever member 50. The thickness of the blade 10 is typically, by way of example, 0.095 inches.

Typically, the angle of inclination of the sharpened edge face 47 on the top side 42 is approximately 15 degrees. Typically, the width of the blade 10, the transverse dimension, is about 1.75 inches. The length of the blade 10 is approximately 11 inches in the longitudinal direction. The blade 10 is thus an elongate blade, which is generally rectangular in shape. The end 26, which includes the slots 28 and 34 comprises the fastener engaging slot end 26 and is spaced from the grip end 24. Other dimensions may be utilized within the scope of the subject matter of the invention.

Figure 3:
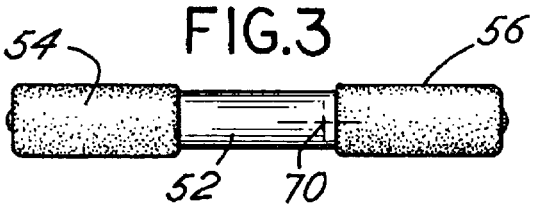
FIG. 3 is an end view of the tool of FIG. 1.
Figure 4:
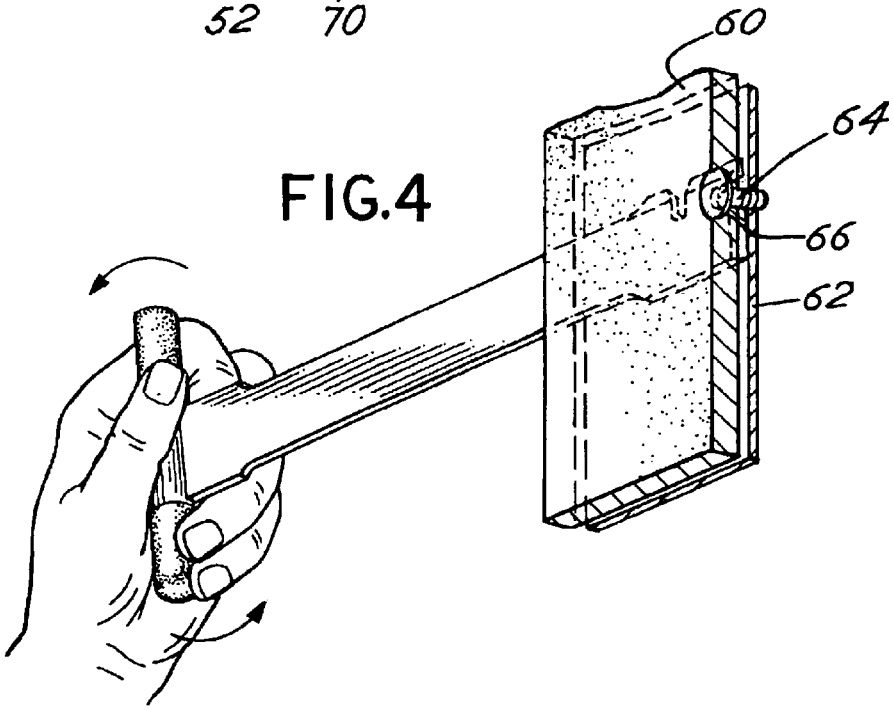
FIG. 4 is an isometric view in partial cross section illustrating the manner of use of the tool of the invention.

In use, as depicted in FIG. 4, the fastener engaging or distal end 26 of the tool is inserted between trim or a trim panel 60 and a substrate panel 62 in a manner wherein one slot 28 or 34 will engage a fastener 64 and more particularly fit under the head 66 of fastener 64. The tool may then be rotated about the inside edge 16 which defines an axis of rotation 70 for the tool. Rotation is effected by twisting of the lever arm or grip 50. Thus, the axis of rotation 70 as depicted in FIG. 3, is defined along the inside edge 16 so that twisting of the blade 10 causes the fastener 64 to be disengaged from the substrate panel 62. Each of the fasteners 64 holding a trim piece or trim panel in position may thus be removed or disengaged from the substrate panel 62 thereby effecting the removal of trim or a trim panel 60 from the substrate panel 62. Other twisting actions may be utilized with the tool. For example, the distal end 26 may serve as a fulcrum. A fulcrum may also be located along the longitudinal axis intermediate the distal end 26 and grip end 24.

In the embodiment depicted two slots 28 and 34 have been described each of which is spaced from the inside edge 16 axis of rotation 70. Additional slots having various configurations may be utilized. The tool is especially useful because of the thinness of the blade 10 and the utilization of the mechanical advantage gained by use of the lever 50 to pivot the tool thereby disengaging a fastener 64. Thus, while there has been set forth a preclude embodiment of the invention it is to be understood that the invention limited only by the following claims and equivalents.

What is claimed is:

1. A trim panel removal tool for disengagement of a fastener that maintains a trim panel on a substrate panel, said tool comprising, in combination;

a thin, elongate, generally rectangularly shape blade having a longitudinal axis, a transverse axis, a fastener engaging end and a manual grip end at the opposite end from the fastener engaging end, said fastener engaging end located longitudinally at one end of the blade and spaced from the grip end by a longitudinal dimension of the blade at least five times greater than a transverse dimension of the blade, said blade including a flat planar top face and a flat planar bottom face spaced from the top face generally about 0.095 inches, said fastener engaging end of the blade including an outside edge and an inside edge, said inside edge spaced from the outside edge, said inside edge generally parallel to the longitudinal axis, said blade including a first fastener engaging slot extending generally longitudinally in the blade from the distal end toward the grip end, said first slot positioned intermediate the inside edge and outside edge, said blade further including a second fastener engaging slot generally transverse to the longitudinal axis at the fastener engaging end extending from the outside edge toward the inside edge, said first and second fastener engaging slots each including sharpened edges located on opposite sides of the respective slots, said edges all formed as an inclined plane comprised of the flat, planar bottom face and a flat, planar upwardly inclined face forming an inclined angle of about 15° with the bottom face, said sharpened edges on opposite sides of the second slot inclined upwardly and inwardly from the outside edge to the top face, said sharpened edges on the opposite sides of the first slot inclined upwardly and inwardly from the distal end to the top face; and a blade handle attached to the grip end, said blade handle comprising a bar member extending in opposite directions from the longitudinal axis beyond the inside and outside edges of the blade and forming a lever for pivotal motion of the blade about the inside edge of the blade, whereby the inclined planar face of the sharpened edges adjacent either the first slot or the second slot of the blade are insertable under and against the head of a fastener and the blade twisted about either the inside edge to disengage the fastener from the substrate panel or alternatively the blade may be pivoted about the distal end to disengage the fastener from the substrate panel, or alternatively the blade may be pivoted about a fulcrum intermediate the distal end and the grip end to disengage the fastener from the substrate panel.

* * * * *